US011828046B2

(12) United States Patent
Myers et al.

(10) Patent No.: US 11,828,046 B2
(45) **Date of Patent: *Nov. 28, 2023**

(54) OBJECT RESPONSIVE CONTROL SYSTEM FOR A WORK MACHINE

(71) Applicant: Deere & Company, Moline, IL (US)

(72) Inventors: David Myers, Dubuque, IA (US); Kevin W. Campbell, Dubuque, IA (US)

(73) Assignee: Deere & Company, Moline, IL (US)

( * ) Notice: Subject to any disclaimer, the term of this patent is extended or adjusted under 35 U.S.C. 154(b) by 475 days.

This patent is subject to a terminal disclaimer.

(21) Appl. No.: 17/247,629

(22) Filed: Dec. 18, 2020

(65) Prior Publication Data

US 2021/0108394 A1 Apr. 15, 2021

Related U.S. Application Data

(63) Continuation of application No. 15/989,370, filed on May 25, 2018, now Pat. No. 10,883,256.

(51) Int. Cl.

| | |
|---|---|
| ***E02F 9/26*** | (2006.01) |
| ***E02F 9/20*** | (2006.01) |
| ***E02F 9/24*** | (2006.01) |
| ***B66F 9/075*** | (2006.01) |
| ***B66F 17/00*** | (2006.01) |

(52) U.S. Cl.

CPC ..... *E02F 9/26* (2013.01); *B66F 9/075* (2013.01); *B66F 9/07509* (2013.01); *B66F 9/07568* (2013.01); *B66F 17/003* (2013.01); *E02F 9/2058* (2013.01); *E02F 9/2083* (2013.01); *E02F 9/2087* (2013.01); *E02F 9/24* (2013.01)

(58) Field of Classification Search

None

See application file for complete search history.

(56) References Cited

U.S. PATENT DOCUMENTS

| | | | | |
|---|---|---|---|---|
| 6,377,205 | B1 | 4/2002 | Eckersten et al. | |
| 6,539,294 | B1 | 3/2003 | Kageyama | |
| 8,244,409 | B2 * | 8/2012 | Bergsten | B60T 8/1766 701/1 |
| 8,457,828 | B2 | 6/2013 | Self et al. | |
| 8,477,021 | B2 * | 7/2013 | Slack | B60Q 9/008 342/70 |
| 8,560,181 | B2 * | 10/2013 | Ekvall | E02F 9/2029 701/52 |
| 9,206,026 | B2 * | 12/2015 | Aulton | B66F 17/003 |
| 9,523,180 | B2 | 12/2016 | Deines | |

(Continued)

FOREIGN PATENT DOCUMENTS

WO WO2016148310 A1 4/2017

*Primary Examiner* — Jonathan M Dager

(57) ABSTRACT

An object responsive control system for a work machine having a boom, an attachment pivotally coupled to the boom, an object sensor adapted for sensing the presence of an undesirable object located in a travel path of the work machine and delivering an object signal upon sensing the undesirable object. A controller adapted for receiving a boom position signal, an attachment position signal, and calculating an elevational position based on the boom position signal. The system activating an object response upon calculating an attachment elevation position above a predetermined threshold and receiving an object signal.

18 Claims, 7 Drawing Sheets

(56) References Cited

U.S. PATENT DOCUMENTS 9,575,170 B2 2/2017 Kurono et al.
9,580,883 B2 2/2017 Singh et al.
9,598,841 B2 * 3/2017 Ikegami ..... E02F 9/2271
9,718,402 B2 8/2017 Smyth et al.
9,747,802 B2 * 8/2017 Fisher ..... B60W 30/09
9,796,267 B1 10/2017 Ruth et al.
10,250,812 B2 * 4/2019 Oblak ..... E02F 9/261
10,583,737 B2 3/2020 Chiba et al.
10,585,183 B2 3/2020 Cornic et al.
10,648,159 B2 * 5/2020 Kaiso ..... E02F 3/32
10,747,227 B2 * 8/2020 Houle ..... B60W 10/18
10,801,177 B2 * 10/2020 Ready-Campbell .... E02F 3/439
10,899,585 B2 * 1/2021 Tasch ..... B66C 15/065
2007/0103282 A1 5/2007 Caird et al.
2010/0194175 A1 8/2010 Hackelboerger et al.
2010/0223008 A1 * 9/2010 Dunbabin ..... E02F 9/262 701/301
2010/0289899 A1 * 11/2010 Hendron ..... B60R 1/00 348/148
2011/0221628 A1 9/2011 Kamo et al.
2012/0327261 A1 * 12/2012 Tafazoli Bilandi ..... E02F 9/24 348/E5.022
2013/0038484 A1 2/2013 Ohkado et al.
2013/0088593 A1 * 4/2013 Ishimoto ..... E02F 9/261 348/143
2013/0099910 A1 4/2013 Merritt
2013/0222592 A1 8/2013 Gieseke
2014/0088824 A1 * 3/2014 Ishimoto ..... G06V 20/56 348/148
2014/0188333 A1 * 7/2014 Friend ..... E02F 9/261 701/34.4
2014/0293051 A1 * 10/2014 Nakamura ..... E02F 9/264 348/148
2014/0354813 A1 * 12/2014 Ishimoto ..... E02F 9/24 348/148
2015/0066349 A1 3/2015 Chan et al.
2016/0123146 A1 * 5/2016 Makela ..... E21B 7/025 701/50
2016/0217331 A1 * 7/2016 Kowatari ..... H04N 7/181
2016/0232771 A1 * 8/2016 Mendiola ..... F16P 3/14
2016/0264134 A1 * 9/2016 Ohsugi ..... B60W 10/18
2016/0312446 A1 * 10/2016 Pettersson ..... H04N 7/181
2017/0073935 A1 * 3/2017 Friend ..... E02F 9/265
2017/0217737 A1 * 8/2017 Rudy ..... B66C 13/46
2017/0361708 A1 12/2017 Thoreson
2018/0044893 A1 * 2/2018 Machida ..... G01S 13/04
2018/0066415 A1 * 3/2018 Friend ..... E02F 9/262
2018/0119383 A1 * 5/2018 Glasser ..... E02F 9/121
2018/0171590 A1 * 6/2018 Kean ..... E02F 3/434
2018/0178342 A1 * 6/2018 Russell ..... G05B 19/402
2018/0222390 A1 * 8/2018 Imaizumi ..... E02F 9/261
2018/0274206 A1 * 9/2018 Kozui ..... E02F 9/262
2018/0347150 A1 * 12/2018 Moriki ..... E02F 9/2004
2018/0352162 A1 * 12/2018 Oblak ..... G06V 10/235
2019/0061763 A1 2/2019 Takeda et al.
2019/0071289 A1 * 3/2019 Mayer ..... B66C 13/46
2019/0092291 A1 3/2019 Pink et al.
2019/0093311 A1 * 3/2019 Naito ..... E02F 9/0858
2019/0129435 A1 5/2019 Madsen et al.
2019/0217857 A1 * 7/2019 Sorin ..... B60W 60/0023
2019/0241408 A1 * 8/2019 Strahl ..... B66C 13/46
2019/0244023 A1 8/2019 Havnor et al.
2019/0367030 A1 * 12/2019 Tanaka ..... G08G 1/165
2020/0048052 A1 * 2/2020 Lyngbäck ..... G06T 19/006
2020/0063399 A1 * 2/2020 Miller ..... E02F 9/265
2020/0094887 A1 * 3/2020 Johnson ..... B62D 33/073
2020/0131741 A1 * 4/2020 Lehmann ..... E02F 9/264
2020/0181881 A1 * 6/2020 Graves ..... G08G 1/166
2020/0315083 A1 * 10/2020 Mei ..... A01B 69/00
2020/0340205 A1 * 10/2020 Naito ..... E02F 9/262
2021/0002859 A1 * 1/2021 Wu ..... G08G 1/161
2021/0124364 A1 * 4/2021 Moorehead ..... E02F 9/262
2021/0163270 A1 * 6/2021 Kosaka ..... B66C 23/88
2021/0171324 A1 * 6/2021 Zhao ..... B66C 15/045
2021/0301494 A1 * 9/2021 Berry ..... E02F 9/205
2021/0340723 A1 * 11/2021 Velde ..... E02F 9/24
2022/0170242 A1 * 6/2022 Maley ..... E02F 9/205
2022/0298743 A1 * 9/2022 Zhdanov ..... E02F 3/439
2022/0341129 A1 * 10/2022 Anahara ..... E02F 3/962
2022/0389685 A1 * 12/2022 Kovanen ..... G06V 20/52
2023/0060815 A1 * 3/2023 Massey ..... E02F 3/34

* cited by examiner

OBJECT RESPONSIVE CONTROL SYSTEM FOR A WORK MACHINE

CROSS-REFERENCE TO RELATED APPLICATIONS

The present patent application is a continuation application of U.S. patent application Ser. No. 15/989,370, titled "Object Responsive Control System for a Work Machine" and filed at the United States Patent and Trademark Office on May 25, 2018; the content of which is incorporated herein by reference.

FIELD OF THE DISCLOSURE

The present disclosure relates to an object responsive control system for a work machine, and more particularly activating an object response when an undesirable object is sensed.

BACKGROUND

Work machine often operate in harsh environments, one of which may include sharp and jagged volcanic rock. Some materials (e.g. volcanic rock) may severely damage the ground engaging supports of a work machine and its frame while the work machine is propelling forwards. However, this damage only occurs when the attachment is in a carrying or dumping position where the linkage connecting the attachment to the work machine, the attachment, and the load pile obstructs the operator's view of the travel path. The following disclosure helps address the issues of potential damage to the work machine and improving its safety during operation in such environments.

SUMMARY

This summary is provided to introduce a selection of concepts that are further described below in the detailed description and accompanying drawings. This summary is not intended to identify key or essential features of the appended claims, nor is it intended to be used as an aid in determining the scope of the appended claims.

The present disclosure includes an object responsive control system which allows the control system for a work machine to activate an object response when an undesirable object is sensed in a travel path of the work machine, and when the attachment of the work machine meets certain positional requirements. More specifically, an object response is activated when the attachment has attained an elevational position above a predetermined threshold.

According to an aspect of the present disclosure, the following is an object responsive control system for a work machine that has a frame, a longitudinal axis, ground engaging supports to support the frame on a geographic surface, and a prime mover mounted on the work machine where the prime mover is drivingly coupled to the ground engaging supports. The prime mover propels the work machine over the geographic surface.

The control system comprises a boom pivotally coupled to the frame; an attachment pivotally coupled to the boom, the attachment extending in a direction transverse to the longitudinal axis of the work machine; an object sensor; a boom sensor adapted for delivering a boom position signal; an attachment sensor adapted for delivering an attachment position signal; and a controller. The object sensor is adapted for sensing the presence of an undesirable object located on the geographic surface in a travel path of the work machine, and further adapted to deliver an object signal upon sensing the undesirable object on the geographical surface. The controller is adapted for receiving the boom position signal, receiving the attachment position signal, calculating an attachment elevation position based on the boom position signal and the attachment position signal; and further adapted to activate an object response upon calculating an attachment elevation position above a predetermined threshold and receiving an object signal. Calculating an elevational position may further comprise a recognition of a type of the attachment.

The system further comprises an operator station. The operator station is supported by the frame, and defines a location for an operator to operate the work machine while facing the attachment. The predetermined threshold is defined by the elevational level where the operator's view of the travel path is at least partially obstructed by the attachment.

The attachment may either be a bucket, a fork, or a spear.

The object sensor may be further adapted to activate a secondary object signal upon sensing the undesirable object on the geographical surface in the travel path of the work machine and elevationally below the attachment of the work machine.

The object sensor may be further adapted for sensing the presence of an undesirable object from an operator's point of view through a windshield of the operator's station within a field of view of the windshield.

The object sensor may comprise of at least one of a laser sensor, a radar sensor, an infrared sensor, an acoustic sensor, a light sensor, a color sensor, and a camera.

The controller is further adapted to deactivate the object response upon calculating an attachment elevation position below the predetermined threshold.

The object response can be at least one of an audible alarm, a visual indicator, an automated reduction in propel speed of the work machine, or an automated electro-hydraulic braking of the ground-engaging supports.

According to an aspect of the present disclosure, a method for providing an object responsive control for a work machine may include one or more of the following steps: propelling the work machine in a travel path on the geographic surface; sensing an undesirable object located on the geographic surface in the travel path of the work machine; delivering an object signal upon sensing the undesirable object on the geographical surface in the travel path of the work machine; delivering a boom position signal; delivering an attachment position signal; calculating an attachment elevation position based on the boom position signal and the attachment position signal; and activating an object response upon calculating an attachment elevation position above a predetermined threshold and receiving an object signal. The predetermined threshold may define an attachment elevation level where the operator's view of the travel path is at least partially obstructed by an attachment when operating the work machine from an operator's station. The operator's view of the travel path is defined by an operator's point of view through a windshield of the operator station within a field of view of the windshield. The attachment may comprise of a bucket, a fork, or a spear. Calculation of the elevational position may further comprise a recognition of a type of attachment.

The method may further comprise deactivating the object response upon calculating an attachment elevation position below the predetermined threshold.

The method may further comprise activating a second object response upon sensing the undesirable object on the geographical surface in the travel path of the work machine and elevationally below the attachment of the work machine. The object response is at least one of an audible alarm, a visual indicator, an automated reduction in propel speed, or an automated electro-hydraulic braking of the ground-engaging supports.

These and other features will become apparent from the following detailed description and accompanying drawings, wherein various features are shown and described by way of illustration. The present disclosure is capable of other and different configurations and its several details are capable of modification in various other respects, all without departing from the scope of the present disclosure. Accordingly, the detailed description and accompanying drawings are to be regarded as illustrative in nature and not as restrictive or limiting.

BRIEF DESCRIPTION OF THE DRAWINGS

The detailed description of the drawings refers to the accompanying figures in which.

DETAILED DESCRIPTION

The embodiments disclosed in the above drawings and the following detailed description are not intended to be exhaustive or to limit the disclosure to these embodiments. Rather, there are several variations and modifications which may be made without departing from the scope of the present disclosure.

Figure 1A:
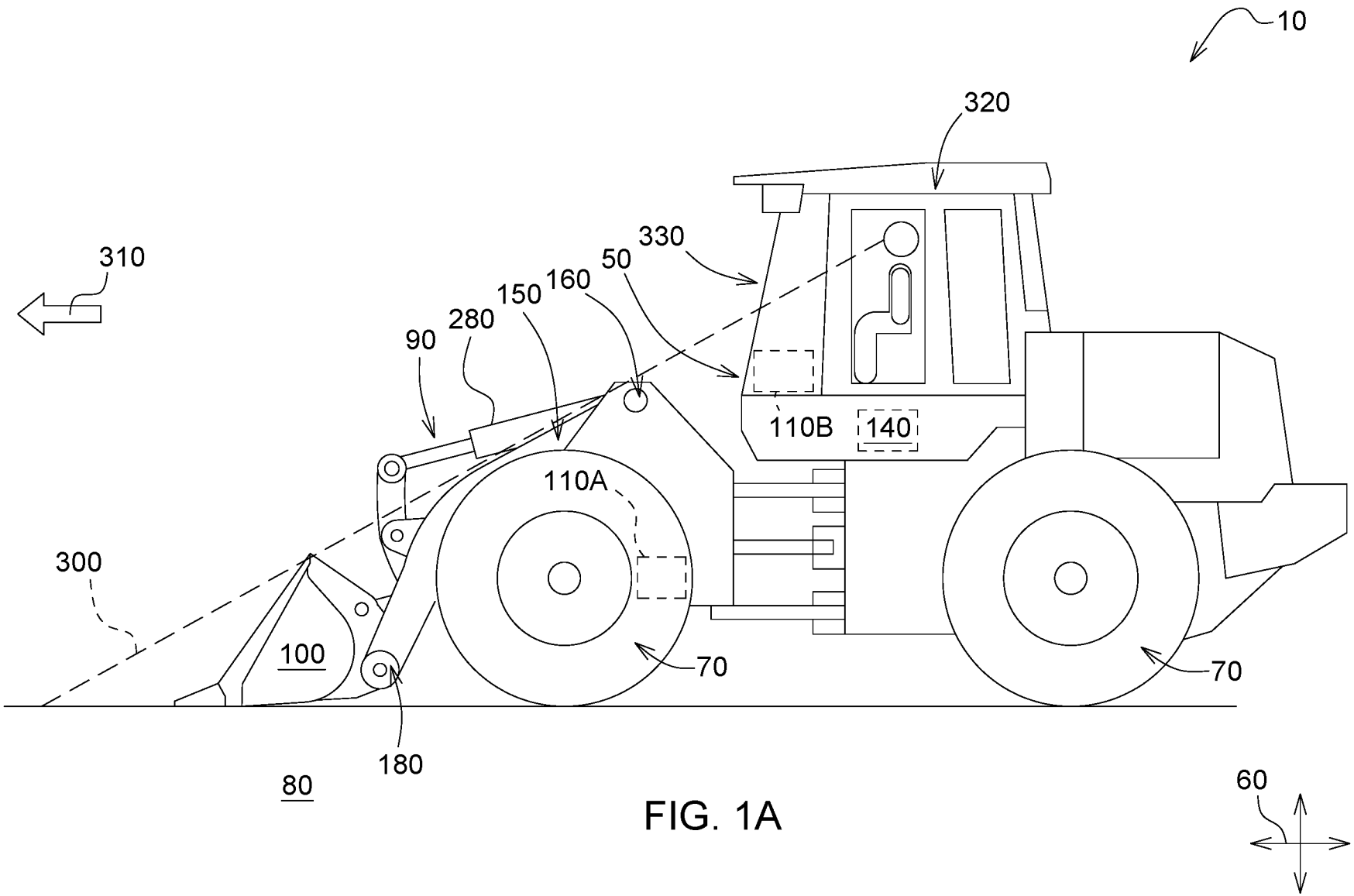
FIG. 1A is a schematic side view of an embodiment of a work machine with a boom pivotally coupled to the frame, and an attachment pivotally coupled to the boom in a loading position.
Figure 1B:
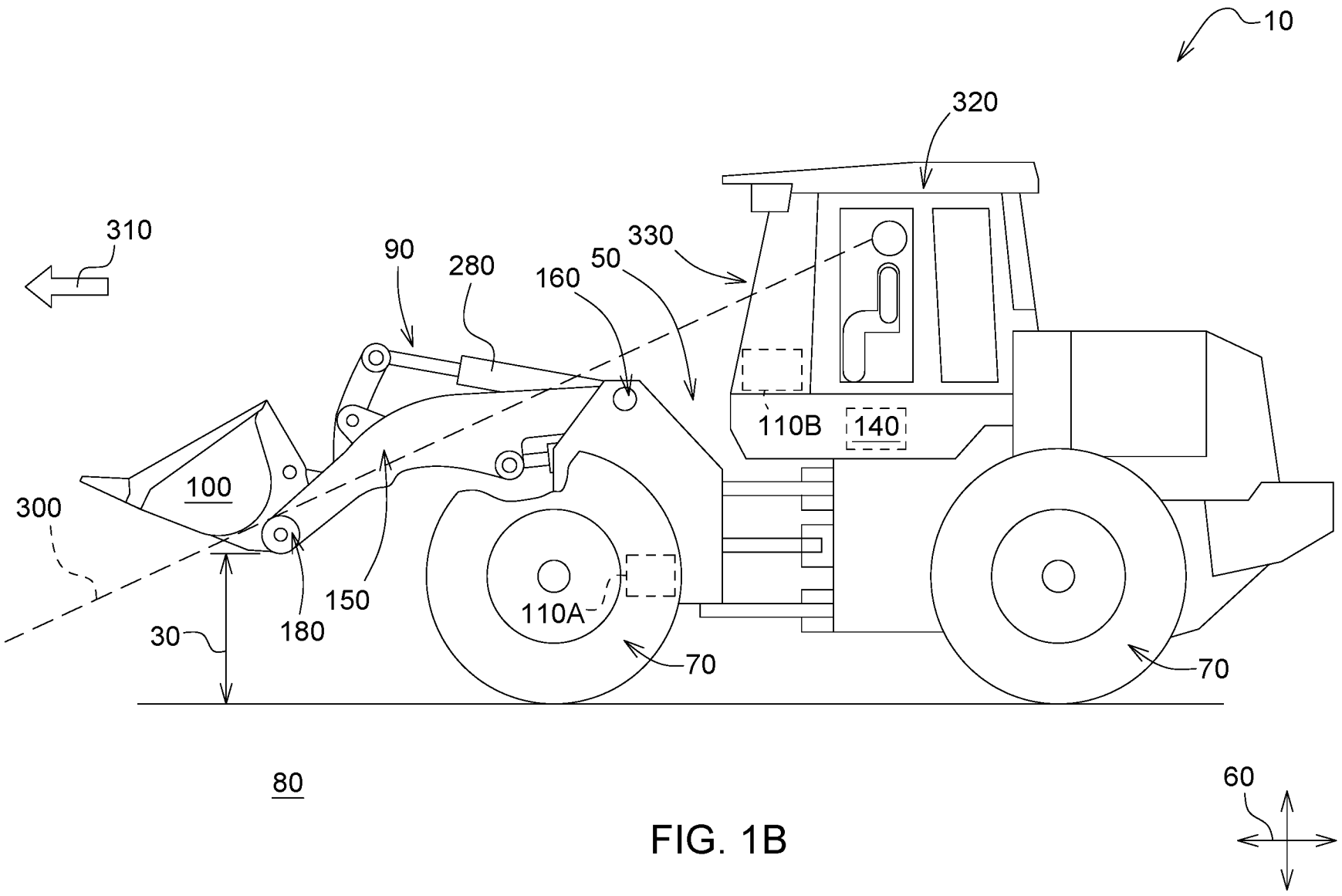
FIG. 1B is a schematic side view of the embodiment in 1A in a first carrying position.
Figure 1C:
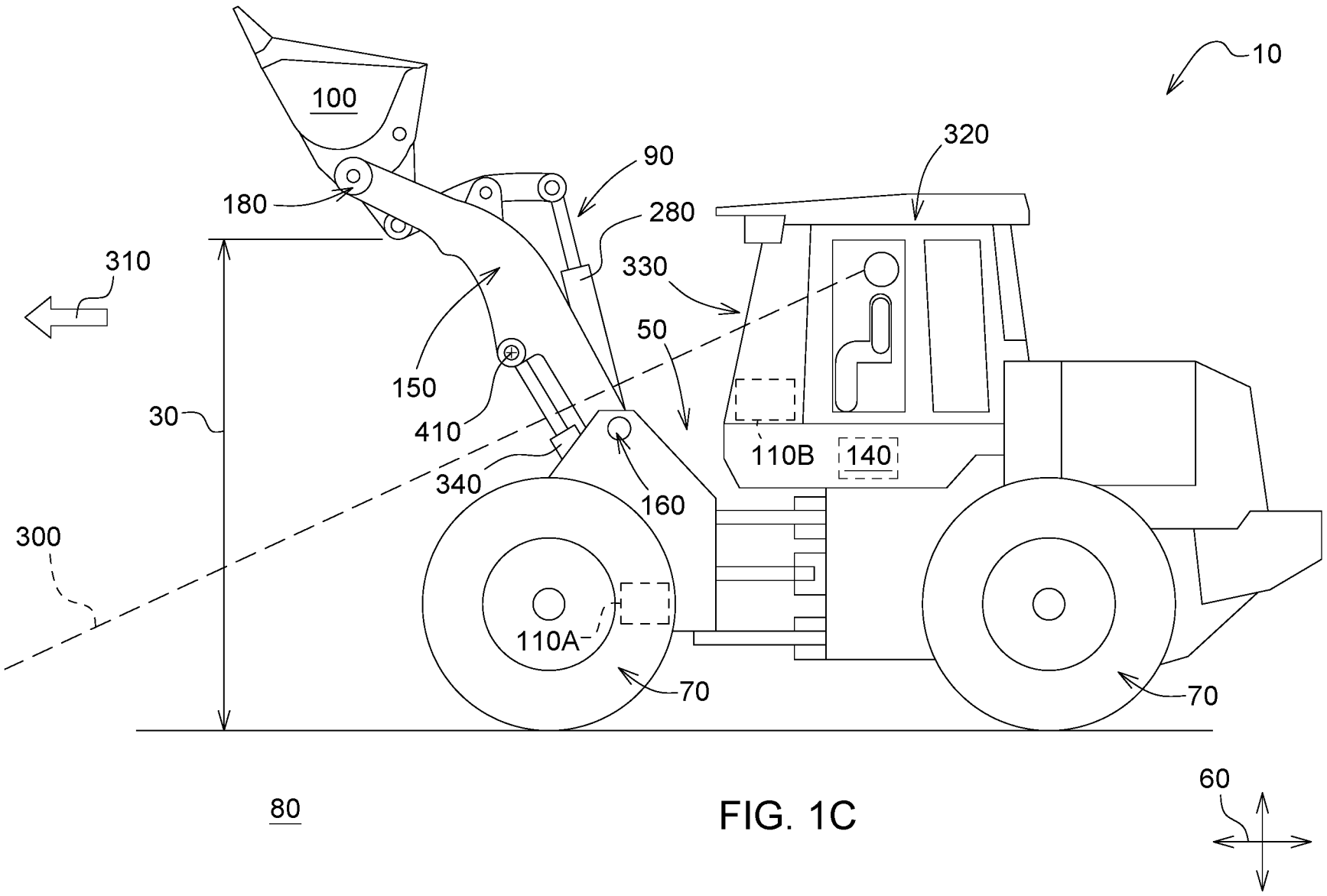
FIG. 1C is a schematic side view of the embodiment in 1A in a second carrying position.

FIGS. 1A through 1C illustrate a work machine 10 with an object responsive control system 20 (shown in FIG. 3) adapted to activate an object response upon calculating an attachment elevation position 30 above a predetermined threshold and upon receiving an object signal 40. The particular work machine 10 shown in FIGS. 1A through 1C is a loader. However, it is to be noted that other work machines, such as dozers, skid steers, crawlers, backhoes and the like may be equivalent and within the scope of this disclosure. The work machine 10 has a frame 50, a longitudinal axis 60 extending along the length of the frame 50, and ground engaging supports 70 to support the frame 50 on a geographic surface 80. The ground engaging supports 70 may include tracks, wheels, or other supports that assist in moving the work machine. A prime mover (not shown), such as an internal combustion engine, is mounted on the frame 50 and is drivingly coupled to the ground engaging supports 70 through conventional means, such as mechanical fluid, or a hydrostatic transmission (not shown). The prime mover mobilizes the ground engaging supports 70 and propels the work machine 10 over the geographic surface 80.

Figure 3:
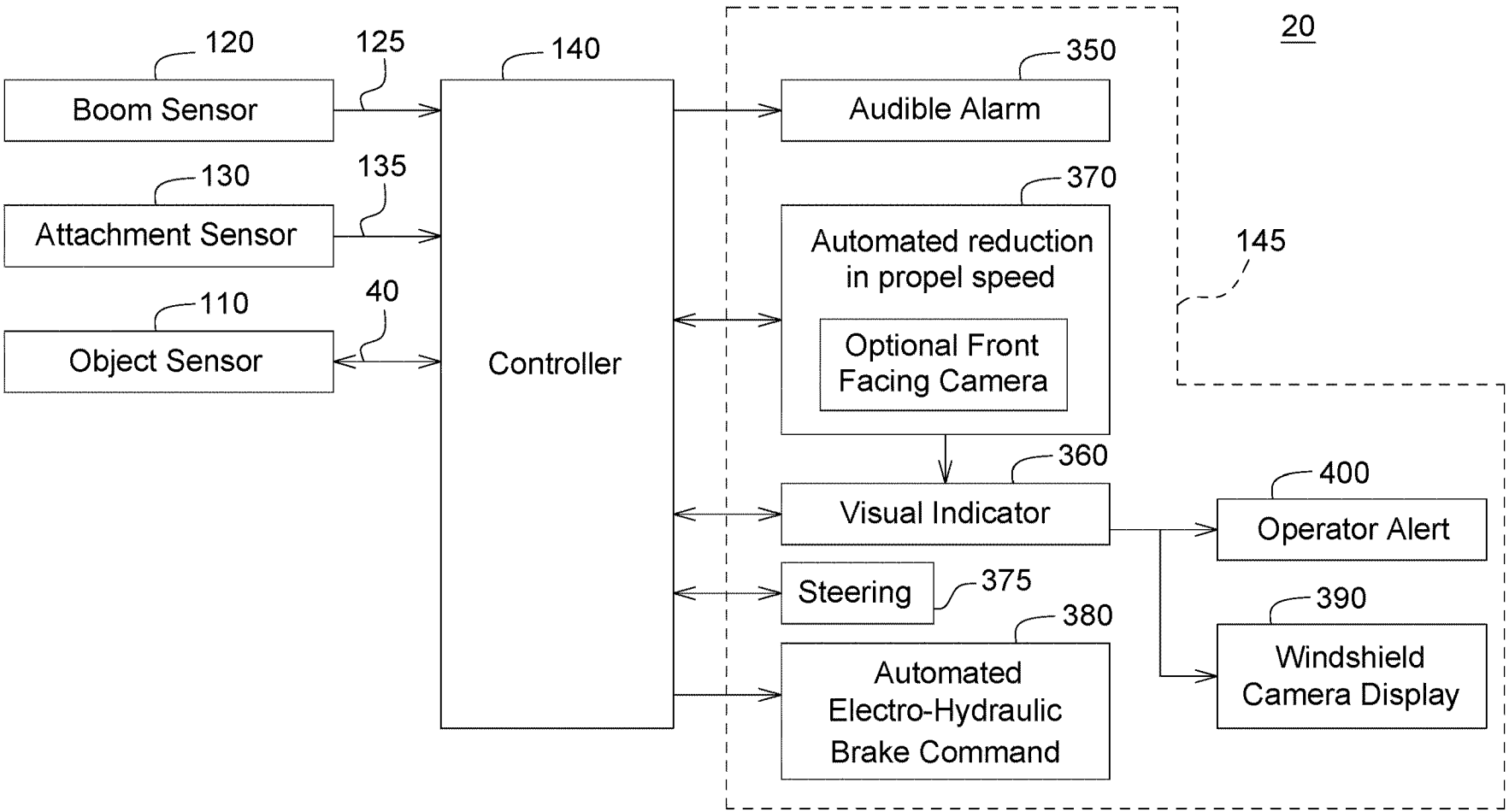
FIG. 3 is a block diagram of the object responsive control system.

As shown in FIG. 3, the system 20 comprises a boom 90 pivotally coupled to the frame 50 (FIGS. 1A-1C), an attachment 100 pivotally coupled to the boom 90 (FIGS. 1A-1C), an object sensor (110A or 110B), a boom sensor 120, an attachment sensor 130, and a controller 140. Now turning to FIGS. 1A-1C, the boom 90 may comprise of a forwardly projecting boom arm 150 pivotally mounted on the frame 50 to pivot about an axis 160, and an attachment 100 (e.g. a bucket) pivotally mounted at the outer end of the boom arm for pivotal movement about an axis 180. The attachment 100 extends in a direction transverse to the longitudinal axis 60 of the work machine 10.

Figure 4A:
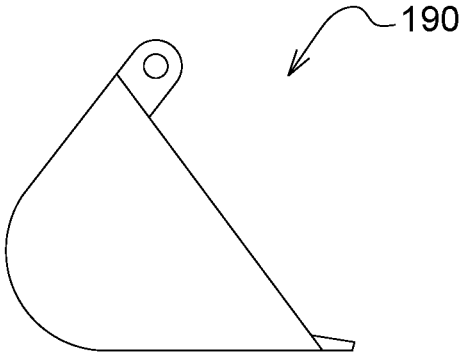
FIG. 4A is a schematic side view of a type of attachment, the bucket.
Figure 4B:
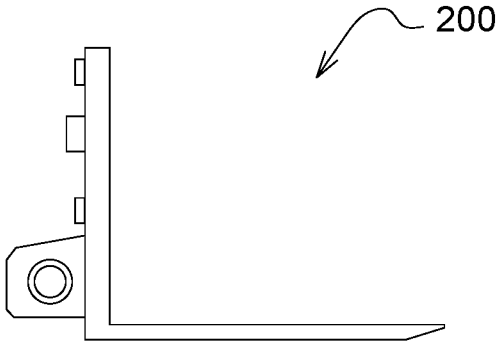
FIG. 4B is a schematic side view of a type of attachment, the spear.
Figure 4C:
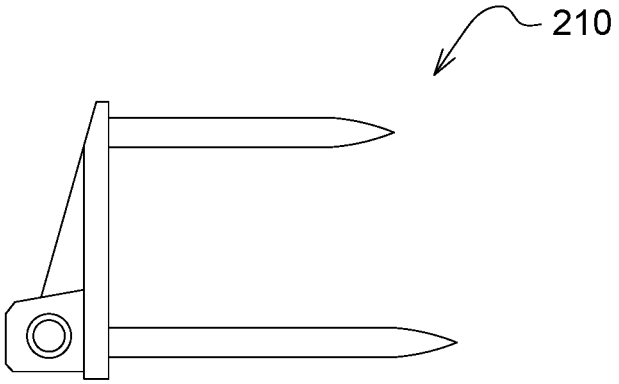
FIG. 4C is a schematic side view of a type of attachment, the fork.

As shown in FIG. 3, the boom sensor 120 is adapted for delivering a boom position signal 125. The attachment sensor 130 is adapted for delivering an attachment position signal 135. The controller 140 is adapted for receiving the boom position signal 125, receiving the attachment position signal 135, and calculating an attachment elevational position 30 (shown in FIGS. 1A-1C) based on the boom position signal 125 and the attachment position signal 135. The controller 140 may be further adapted to activate an object response 145 upon calculating an attachment elevational position 30 above a predetermined threshold and receiving an object signal 40. The attachment 100 may be either a bucket 190, a fork 200, a spear 210, or a similar attachment as shown in FIGS. 4A-4C. Attachment elevational position 30 may be calculated relative to the frame 50 of the work machine. Attachment elevational position 30 may further be calculated as the elevational height from the bottom surface of the attachment to a distance where the ground engaging supports 70 engage the geographic surface 80.

Figure 2:
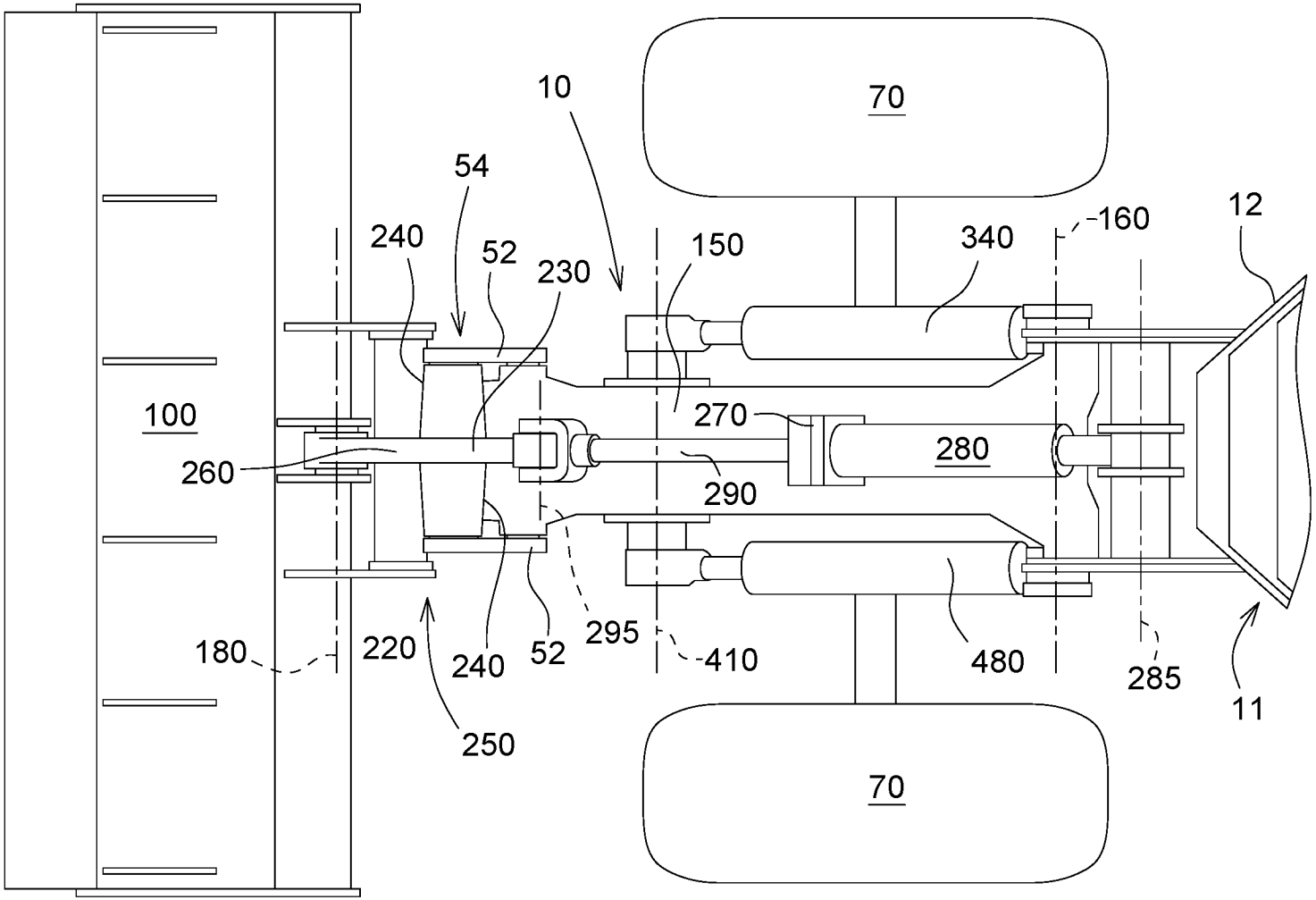
FIG. 2 is a partial top view of the embodiment in FIG. 1A.

Now referring to FIGS. 1A-1C, and 2, in one embodiment of the work machine, a T-bar linkage 250 may interconnect the frame 50 with the attachment 100 and the boom arms 150. The linkage may comprise a unitary cross-shaped bellcrank 260 which comprises a forward arm 220, a rearward arm 230, and lateral arms 240. FIG. 2 shows the cross-shaped configuration of the bellcrank 260. The forward arm 220 of the bellcrank 260 is pivotally coupled to the attachment 100 to pivot about an axis 180. Rearward arm 230 is pivotally coupled to the frame 50 with an intermediate hydraulic cylinder 270. The head end 280 of intermediate hydraulic cylinder 270 is connected to the frame 50 to pivot about an axis 285, while the rod 290 is pivotally connected to bellcrank 260 to pivot about axis 295.

The boom 90 is raised and lowered by a pair of hydraulic cylinders 340, one on each side of the work machine 10. The head ends of hydraulic cylinders 340 are pivotally connected to the frame 50 to pivot about an axis 160. The rod ends of hydraulic cylinders 340 are pivotally connected to boom arms 150 to pivot about axis 410.

In operation the boom 90 may be moved from the loading position as illustrated in FIG. 1A to the carrying position as shown in FIG. 1B or FIG. 1C. This may be accomplished by extending the hydraulic cylinders 340 and simultaneously rolling back the attachment 100 to the carry position by retracting the intermediate hydraulic cylinder 270. In the carry position, the load in the implement may be transported to another location where it is to be discharged. In this elevated carry position, the operator's view 300 (designated by the dotted line) of the travel path 310 from the operator station 320 is typically at least partially obstructed by the attachment 100 and possibly including the load (not shown), while the operator is facing the attachment 100. The operator's view 300 may be defined as the operator's point of view of the travel path 310 through a windshield 330 of the operator's station 320, and within a field of view of the windshield 330. The work machine may encounter obstacles (e.g. large hard rocks, shot rock, stones found in rock quarries) in the field when transporting loads in the carrying position that may cause irreparable damage to its ground engaging supports 70 or frame 50. Whereas, in the loading position as shown in FIG. 1A, the attachment simply "scoops up" the obstacles with the attachment 100. The object responsive control system 20 addresses this issue with a controller 140 adapted to activate an object response upon calculating an attachment elevational position 30 above a predetermined threshold and encountering an undesirable object, activating the object response only when this minimum predetermined threshold is met. This predetermined threshold may be defined by an attachment elevational level position 30 where the operator's view 300 of the travel path 310 is at least partially obstructed by the attachment 100 (e.g. in carrying positions as shown in FIGS. 1B and 1C).

As previously noted, the attachment elevational position 30 may be calculated based on a boom position signal 125 from at least one boom sensor 120, and an attachment position signal 135 from at least one attachment sensor 130.

The boom sensor 120 (shown in FIG. 3) may be associated with the vertical pivoting motion of the attachment 100 imparted by hydraulic cylinders 340 (i.e. associated with the lifting and lowering motions of boom arms 150 relative to frame 50). Specifically, the boom sensor 120 may be an angular position or speed sensor associated with a pivot joint between boom member 150 and frame 50, a displacement sensor associated with the hydraulic cylinders 340, a local or global coordinate position or speed sensor associated with an any linkage member coupling the attachment 100 to frame 50 or the attachment itself, a displacement sensor associated with movement of an operator input device from the operator station 320, or any other type of sensor known in the art that may generate a signal indicative of a pivoting position or speed of the boom 90 relative to the frame 50 of the work machine 10.

The attachment sensor 130 may be associated with the pivoting for of the attachment imparted by hydraulic cylinder 280. Specifically, that attachment sensor 130 may be a pressure sensor associated with one or more chambers within hydraulic cylinder 280, a strain gauge associated with the pivot connections of the attachment, a load cell, or any other type of sensor known in the art that generates a signal indicative of a pivoting force and or position of the attachment 100 of the machine during a loading, carrying, and dumping operation of the work machine 10.

Calculating an attachment elevational position 30 by the controller 140 may further comprise a recognition of the type of attachment 100. The controller may configure the object responsive control system 20 of a work machine 10 including systems operable to control the operation of a plurality of different attachments, each attachment having a set of parameters associated therewith which affect the operation of at least some of the systems of the work machine. The object responsive control system 20 may recognize the particular attachment coupled to the work machine based upon either a signal generated by an attachment recognition system associated with the attachment (RFID, Bluetooth, etc.) when the attachment is coupled to the work machine 10, or based upon operator selectable commands for selecting any one of a plurality of different sets of operating parameters based upon the particular attachment 100 coupled to the work machine 10. Upon recognition, the controller may factor the dimensional parameters or geometry of the attachment when calculating the attachment elevational position 30 because the boom position signal 125 and the attachment position signal 135 may translate into a different attachment elevational position 30 based on the dimensional parameters of the attachment 100. Additionally, the predetermined threshold where an object response may be triggered will also be different based on the dimensional parameters of the attachment 100. For example, a bucket attachment comes in various configurations such as roll-out buckets, grapple buckets, snow blowing buckets, and rock buckets. Each bucket attachment may have different dimensional parameters wherein the elevational height between the bottom surface of the bucket to the geographic surface will be different for each respective bucket. Furthermore, typical use and function of the attachment 100 can also determine the attachment elevational position 30.

The controller 140 may be further adapted to activate an object response upon calculating an attachment elevational position 30 above the predetermined threshold and receiving an object signal 40 from the object sensor 110. The controller 140 may be further adapted to deactivate the object response 145 upon calculating an attachment elevational position 30 below the predetermined threshold. For example, when the work machine 10 returns to a loading position (shown in FIG. 1A) from a carrying position (shown in FIGS. 1B and 1C), any object response will become inactive as the attachment will "scoop up" any undesirable objects in the travel path 310 of the work machine 10. Additionally, the ability for the object responsive control system 20 to activate an object response 145 upon sensing an undesirable object will be inactive when the controller 140 calculates a position below the predetermined threshold.

The object sensor may be a laser sensor, a radar sensor, an infrared sensor, an acoustic sensor, a light sensor, a color sensor, or a camera. The object sensor (110A 110B and generically referred to as 110) may be located in a first position 110A on or near a front surface of the work machine, at an elevation height below the predetermined threshold. Positioning an object sensor 110 in this first position 110A provides ease of detecting whether the attachment 100 is in a loading position or a carrying position. In one example, an object sensor 110 that is a camera may automatically detect the manufacturer's signature colors of the attachment when the attachment is positioned in the loading position (shown in FIG. 1A), and thereby in the camera's field of view and inhibit the system's ability to activate an object response 145. The system 20 would then automatically be enabled to activate an object response once the attachment is moved out of the field of vision of the camera. Alternatively, the object sensor 110 may be located in a position 110B on or near a front surface of the work machine, above the predetermined threshold. The object sensor 110B may be further adapted for sensing the presence of an undesirable object from an operator's point of view through a windshield of the operator's station within a field of view of the windshield. The second position 110B would provide an object response 145 when detecting an undesirable object, the moment the operator's field of view 300 is at least partially obstructed. The object sensor 110 may be coupled to an object recognition software on the controller 140 that further processes the object signal 40, and validates the perceived sensed object as undesirable.

The object sensor 110 may be adapted to activate a secondary object signal upon sensing the undesirable object on the geographical surface in the travel path of the work machine and elevationally below the attachment 100 of the work machine 10 (i.e. directly below the attachment when the attachment is in a carrying position). The secondary object signal may activate a heightened object response as the undesirable object in the path of travel of the work machine nears the work machine and thereby becoming an immediate threat to the ground engaging supports 70 and/or frame 50. This would signal the operator to manually respond or the work machine 10 may be in a mode to automatically create an object response (e.g. an automated hydraulic braking).

An object response 145 may be an audible alarm 350, a visual indicator 360, an automated reduction in propel speed of the work machine 370, steering of the work machine 375, or an automated electrohydraulic braking of the ground engaging supports 380. These are a few examples where the object response is in either a manual mode where the operator is alerted and directs the work machine, or in automatic mode where the work machine automatically responds. For example, an object response is in manual mode when the object response is a visual indicator 360. This visual indicator may include a projected visual display of the travel path onto the windshield where the sensed undesirable objects are highlighted. Alternatively, the projected visual display may only highlight sensed undesirable objects and align the highlighted objects with the operator's point of view so that the graphical elements projected on the windshield 330 overlap with the corresponding objects seen through the windshield. This form of a visual indicator allows for the operator to view the perceived danger without having to look away from the travel path 310.

The aforementioned disclosed features object responsive control system advantageously provides a semi-autonomous capability for the work machine while substantially improving its safety and reducing potential damage to the work machine and/or its attachment.

Figure 5:
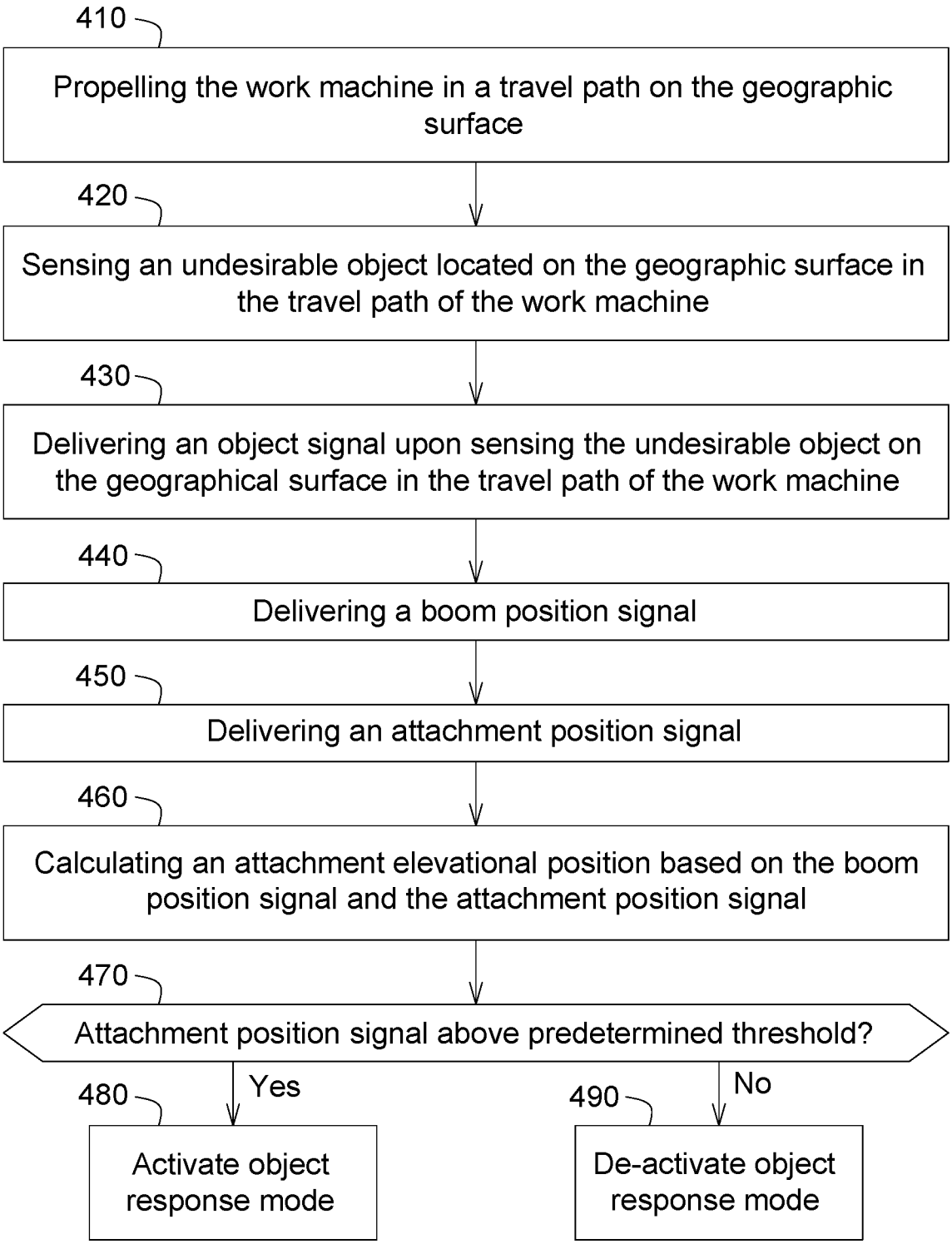
FIG. 5 is a flowchart of a method for providing an object responsive control for a work machine.

FIG. 5 illustrates a method for providing an object responsive control system 30 for a work machine 10 having a frame 50, a longitudinal axis extending along the length of the frame 50, ground engaging supports 70 to support the frame 50 on a geographic surface 80; a prime mover mounted on the work machine 10 and drivingly coupled to the ground engaging supports; an operator station supported by the frame; a boom 90 pivotally coupled to the frame 50; an attachment 100 pivotally coupled to the boom 90; and the attachment extending in a direction transverse to the longitudinal axis of the work machine.

At step 410, the method comprises propelling the work machine 10 in a travel path 310 on the geographic surface 80. The prime mover (not shown) is mounted on the work machine where the prime mover is drivingly coupled to the ground engaging supports 70 through conventional means, such as mechanical fluid, or a hydrostatic transmission. The prime mover mobilizes the ground engaging supports 70 and propels the work machine 10 over the geographic surface 80.

At step 420, the method comprises sensing an undesirable object located on the geographic surface 80 in the travel path 310 of the work machine 10. This will typically be done by an object sensor 110 located someone on a forward facing area of the work machine 10. The object sensor 110 may be a laser sensor, a radar sensor, an infrared sensor, an acoustic sensor, a light sensor, a color sensor, or a camera.

At step 430, the method comprises delivering an object signal 40 upon sensing the undesirable object on the geographic surface 80 in the travel path 310 of the work machine 10. The object sensor 110 may deliver an object signal 40 to the controller 140. The object sensor 110 may be coupled to an object recognition software on the controller 140 that further processes the object signal 40, and validates the perceived object as undesirable.

At step 440, the method comprises delivering a boom position signal 125.

At step 450, the method comprises delivering an attachment position signal 135.

At step 460, the method comprises calculating an attachment elevational position 30 based on the boom position signal 125 and the attachment position signal 135.

At step 470, the method determines whether the attachment position signal 135 is above a predetermined threshold.

At step 480, if yes, then an object response mode is activated. An activated object response mode enable the object responsive control system 20 to enable an object response 145 upon sensing an undesirable object in the travel path 310 of the work machine. An object response 145 may be an audible alarm 350, a visual indicator, an automated reduction in propel speed of the work machine 370, steering of the work machine 375, or an automated electrohydraulic braking of the ground engaging supports 380.

At step 490, if not, then an object response mode remains inactive, or becomes inactivated. Inactiveness of the object response mode, or deactivating the object response mode, inhibits an object response 145 upon the detection of an undesirable object in the travel path of the work machine; or shuts off the object sensor 110; or inhibits delivery of the object signal 40 upon sensing an undesirable object.

One or more of the steps or operations in any of the methods, processes, or systems discussed herein may be omitted, repeated, or re-ordered and are within the scope of the present disclosure.

While the above describes example embodiments of the present disclosure, these descriptions should not be viewed in a restrictive or limiting sense. Rather, there are several variations and modifications which may be made without departing from the scope of the appended claims.

What is claimed is:

1. An object responsive control system for a work machine having a frame, a longitudinal axis, ground engaging supports to support the frame on a geographic surface, a prime mover mounted on the work machine and drivingly coupled to the ground engaging supports, the prime mover propelling the work machine over the geographic surface, the system comprising:

a boom pivotally coupled to the frame;

an attachment pivotally coupled to the boom;

an object sensor adapted for sensing a presence of an undesirable object located in a travel path of the work machine, and further adapted to deliver an object signal upon sensing the undesirable object;

a boom sensor adapted for delivering a boom position signal;

a controller adapted for receiving the boom position signal, and further adapted to activate an object response upon receiving the object signal; and an operator station supported by the frame, the operator station defining a location for an operator to operate the work machine while facing towards the attachment, a predetermined threshold defining where an operator's view of the travel path is at least partially obstructed by the attachment.

2. The system of claim 1, wherein the attachment comprises at least one of a bucket, a fork, and a spear.

3. The system of claim 1, wherein the object sensor is further adapted to activate a secondary object signal upon sensing the undesirable object in the travel path of the work machine.

4. The system of claim 1, wherein the object sensor comprises at least one of a laser sensor, a radar sensor, an infrared sensor, an acoustic sensor, a light sensor, a color sensor, and a camera.

5. The system of claim 1, wherein the object sensor is further adapted for sensing the presence of the undesirable object from the operator's point of view through a windshield of an operator's station within a field of view of the windshield.

6. The system of claim 1, further comprising an attachment sensor for delivering an attachment position signal, the controller further adapted to activate the object response upon receiving the attachment position signal.

7. The system of claim 1, wherein the object response is an automated electro-hydraulic braking of the boom.

8. The system of claim 1, wherein the object response is at least one of an audible alarm, a visual indicator, an automated reduction in propel speed of the work machine, a steering of the work machine, and an automated electro-hydraulic braking of the ground-engaging supports.

9. An object responsive control system for a work machine having a frame, ground engaging supports to support the frame, an operator station supported by the frame, the operator station defining a location for an operator to operate the work machine while facing towards an attachment, a prime mover mounted on the work machine and drivingly coupled to the ground engaging supports, the prime mover propelling the work machine over the geographic surface, the system comprising:

a boom pivotally coupled to the frame;

the attachment pivotally coupled to the boom;

an object sensor adapted for sensing a presence of an undesirable object located in a travel path of the work machine, and further adapted to deliver an object signal for sensing the undesirable object on the geographical surface;

a boom sensor adapted for delivering a boom position signal;

a controller adapted for receiving the boom position signal, calculating an attachment elevational position based on the boom position signal;

and further adapted to activate an object response upon calculating the attachment elevational position above a predetermined threshold and receiving the object signal, wherein the predetermined threshold defines an elevational level where an operator's view of the travel path is at least partially obstructed by the attachment.

10. A method for providing an object responsive control for a work machine having a frame, ground engaging supports to support the frame, a prime mover mounted on the work machine and drivingly coupled to the ground engaging supports, an operator station supported by the frame; a boom pivotally coupled to the frame, an attachment pivotally coupled to the boom, the method comprising:

propelling the work machine on a travel path;

sensing an undesirable object located in the travel path of the work machine;

delivering an object signal upon sensing the undesirable object in the travel path of the work machine;

delivering a boom position signal;

calculating an attachment position based on the boom position signal;

activating an object response based upon receiving the object signal; and wherein a predetermined threshold defines where an operator's view of the travel path is at least partially obstructed by an attachment when operating the work machine from the operator's station.

11. The method of claim 10, wherein the operator's view of the travel path is defined by an operator's point of view though a windshield of an operator station within a field of view of the windshield.

12. The method of claim 10, wherein the attachment comprises at least one of a bucket, a fork, and a spear.

13. The method of claim 10, further comprising delivering an attachment position signal, activating the object response upon receiving the attachment position signal.

14. The method of claim 10, further comprising activating a secondary object response upon sensing the undesirable object in the travel path of the work machine.

15. The method of claim 10, wherein the object response is at least one of an audible alarm, a visual indicator, an automated reduction in propel speed, a steering of the work machine, and an automated electro-hydraulic braking of the ground-engaging supports.

16. The method of claim 10, wherein the object response comprises at least one of an audible alarm and a visual indicator.

17. The method of claim 10, wherein the object response is an automated electro-hydraulic braking of the ground-engaging supports.

18. The method of claim 10, wherein the object response is an automated electro-hydraulic braking of the boom.

* * * * *